US009546767B2

(12) United States Patent
Sato

(10) Patent No.: US 9,546,767 B2
(45) Date of Patent: Jan. 17, 2017

(54) LAMP UNIT AND PROJECTOR LENS

(71) Applicant: KOITO MANUFACTURING CO., LTD., Tokyo (JP)

(72) Inventor: Noriko Sato, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 28 days.

(21) Appl. No.: 13/915,667

(22) Filed: Jun. 12, 2013

(65) Prior Publication Data

US 2013/0335990 A1 Dec. 19, 2013

(30) Foreign Application Priority Data

Jun. 13, 2012 (JP) ..... 2012-133503

(51) Int. Cl.
*F21S 8/10* (2006.01)

(52) U.S. Cl.
CPC ..... *F21S 48/125* (2013.01); *F21S 48/1159* (2013.01); *F21S 48/1258* (2013.01); *F21S 48/1266* (2013.01); *F21S 48/14* (2013.01); *F21S 48/145* (2013.01); *F21S 48/1283* (2013.01); *F21S 48/1329* (2013.01)

(58) Field of Classification Search
CPC .. F21S 48/125; F21S 48/1258; F21S 48/1266; F21S 48/1275; F21S 48/1283; F21S 48/1291; F21S 48/137; F21S 48/1154; F21S 48/1329; F21S 48/1159
USPC ..... 362/538, 539, 514, 516, 520, 522, 529,362/308, 309, 326, 335, 223, 507
See application file for complete search history.

(56) References Cited

U.S. PATENT DOCUMENTS 6,007,223 A * 12/1999 Futami ..... 362/517
6,132,068 A * 10/2000 Katsumata ..... 362/351
6,819,505 B1 * 11/2004 Cassarly et al. ..... 359/726
6,948,836 B2 * 9/2005 Ishida et al. ..... 362/516
7,261,449 B2 * 8/2007 Albou ..... 362/518
(Continued)

FOREIGN PATENT DOCUMENTS

DE 102004005932 A1 8/2004
DE 102006053020 A1 5/2008
(Continued)

OTHER PUBLICATIONS

Office Action issued Mar. 8, 2016, issued by the Japanese Patent Office in counterpart Japanese Patent Application No. 2012-133503.
(Continued)

*Primary Examiner* — Elmito Breval
*Assistant Examiner* — Arman B Fallahkhair
(74) *Attorney, Agent, or Firm* — Sughrue Mion, PLLC

(57) ABSTRACT

A lamp unit 10 is one for use in a vehicle lamp. The lamp unit 10 includes a light source mounting portion on which a light source is mounted, and a projector lens 100 that is disposed on a vehicle front side of the light source. The projector lens includes an incident surface 100*a* on which light emitted from the light source is incident, a convex emission surface 100*b* from which the light incident on the incident surface is emitted forwardly of the lamp, a connection surface 100*c* that connects an edge part of the incident surface 100*a* and an edge part of the emission surface 100*b*. The connection surface 100*c* includes, at least in a partial area thereof, a convex surface that is convex, in section including an optical axis, outward in a diameter direction.

18 Claims, 7 Drawing Sheets

(56) References Cited

U.S. PATENT DOCUMENTS

| | | | | |
|---|---|---|---|---|
| 7,654,713 | B2 * | 2/2010 | Tendo et al. | 362/538 |
| 7,682,057 | B2 * | 3/2010 | Albou | F21S 48/1159 359/853 |
| 7,699,513 | B2 * | 4/2010 | Nakada et al. | 362/538 |
| 7,736,036 | B2 * | 6/2010 | Tatsukawa | F21S 48/1154 359/726 |
| 7,810,975 | B2 * | 10/2010 | Specht et al. | 362/555 |
| 7,934,861 | B2 * | 5/2011 | Albou | 362/539 |
| 8,042,980 | B2 * | 10/2011 | Ookubo et al. | 362/512 |
| 8,678,628 | B2 * | 3/2014 | Futami | 362/522 |
| 9,022,625 | B2 * | 5/2015 | Okubo | F21S 48/1154 362/296.05 |
| 2004/0114393 | A1 | 6/2004 | Galli | |
| 2012/0243250 | A1 * | 9/2012 | Yagi | 362/520 |

FOREIGN PATENT DOCUMENTS

| | | | |
|---|---|---|---|
| EP | 1715245 | A1 | 10/2006 |
| EP | 1965126 | A1 | 9/2008 |
| EP | 2199662 | A1 | 6/2010 |
| FR | 2898662 | A1 | 9/2007 |
| JP | 2003317513 | A | 11/2003 |
| JP | 2008-103192 | A | 5/2008 |
| JP | 2009-266710 | A | 11/2009 |
| JP | 2011249056 | A | 12/2011 |

OTHER PUBLICATIONS

Extended European Search Report issued on May 10, 2016 by the European Patent Office in counterpart European Application No. 13171766.2.

* cited by examiner

LAMP UNIT AND PROJECTOR LENS

CROSS REFERENCE TO RELATED APPLICATION(S)

This application is based on and claims priority under 35 U.S.C. §119 to Japanese Patent Application No. 2012-133503 (filed on Jun. 13, 2012), the entire contents of which are incorporated herein by reference.

BACKGROUND

1. Technical Field

The invention relates to a lamp unit, and more particularly, to a lamp unit that is mounted on a vehicle.

2. Description of Related Art

JP 2003-317513 A describes a light source unit for use in a vehicle lamp. The light source unit includes a semiconductor light emitting element and a reflector. The semiconductor light emitting device is disposed on an optical axis of the light source unit so as to be directed in a predetermined direction substantially perpendicular to the optical axis. The reflector collects and reflects light, which is emitted from the semiconductor light emitting element, forward in the optical axis direction and to the optical axis.

In the vehicle lamp having the light source unit, a projector lens is provided in front of the light source unit. The light emitted from the light source is illuminated forwardly of the lamp unit through the projector lens. A plano-convex lens which has a round shape when viewed from the front side of the lamp is used as the projector lens.

SUMMARY

In the above-described vehicle lamp, a part of the light emitted from the light source and reflected by the reflector passes through a position which is apart from a focal point of the projector lens. Such light is incident on a position near an outer peripheral portion of the projector lens. Therefore, in some circumstances, the light incident on an incident surface may be reflected by an inside of a side surface of the projector lens before reaching an emission surface thereof. When the light reflected by the inside of the side surface of the projector lens is emitted upwards from the emission surface, for example, it generates glare ahead of a vehicle.

The invention has been made in view of the above circumstances and provides a technology that realizes a desired light distribution with accuracy in a vehicle lamp.

According to one embodiment, a lamp unit for use in a vehicle lamp includes a light source mounting portion and a projector lens. A light source is mounted on the light source mounting portion. The projector lens is disposed on a vehicle front side of the light source. The projector lens includes an incident surface, a convex emission surface, and a connection surface. Light emitted from the light source is incident on the incident surface. The light incident on the incident surface is emitted from the convex emission surface forwardly of the lamp. The connection surface connects an edge part of the incident surface and an edge part of the emission surface. The connection surface includes, at least in a partial area thereof, a convex surface that is convex, in section including an optical axis, outward in a diameter direction of the projector lens.

With the above mode, in the case where the light incident on the projector lens is internally reflected by the connection surface, the light reflected by the convex surface reaches the convex emission surface of the projector lens with an acute angle with respect to the convex emission surface of the projector lens, as compared with a connection surface having a flat (linear) shape in section including an optical axis. Therefore, the light reflected by the connection surface is apt to be totally reflected by the emission surface of the projector lens, and it is hard that the light reflected by the connection surface is illuminated forwardly from the emission surface of the projector lens.

The connection surface may be configured so that an area of the connection surface that is positioned at a lower part of the reflector lens when the lamp unit is used in the vehicle lamp makes up the convex surface. Thereby, of the light reflected by an inside of the connection surface, the light emitted upward from the emission surface is reduced, and generation of glare ahead of the vehicle is suppressed.

The partial area may be formed so as to have an arc shape or a circular arc shape in section including the optical axis.

The incident surface and the emission surface may be formed so that widths in a horizontal direction are larger than heights in a vertical direction. In the projector lens in which the heights in the vertical direction are different from the widths in the horizontal direction, the shape of the connection surface is non-uniform and complicated in many cases. Therefore, in view of the optical design, it is often difficult to use the light, which is internally reflected by the connection surface, for the desired light distribution ahead of the vehicle. Thus, the projector lens having the shape of the connection surface as described above is preferable.

According to another embodiment, a projector lens for use in a vehicle lamp includes an incident surface, a convex surface, and a connection surface. Light emitted from a light source is incident on the incident surface. The light incident on the incident surface is emitted from the convex emission surface forwardly of the lamp. The connection surface connects an edge part of the incident surface and an edge part of the emission surface. The connection surface includes, at least in a partial area thereof, a convex surface that is convex, in section including an optical axis, outward in a diameter direction of the projector lens.

With the above mode, in the case where the light incident on the projector lens is internally reflected by the connection surface, the light reflected by the convex surface reaches the convex emission surface of the projector lens with an acute angle with respect to the convex emission surface of the projector lens, as compared with a connection surface having a flat (linear) shape in section including an optical axis. Therefore, the light reflected by the connection surface is apt to be totally reflected by the emission surface of the projector lens, and it is hard that the light reflected by the connection surface is illuminated forwardly from the emission surface of the projector lens.

The above configurations make it possible to provide a technology that realizes a desired light distribution with accuracy in a vehicle lamp.

DETAILED DESCRIPTION OF EXEMPLARY EMBODIMENTS

Figure 1:
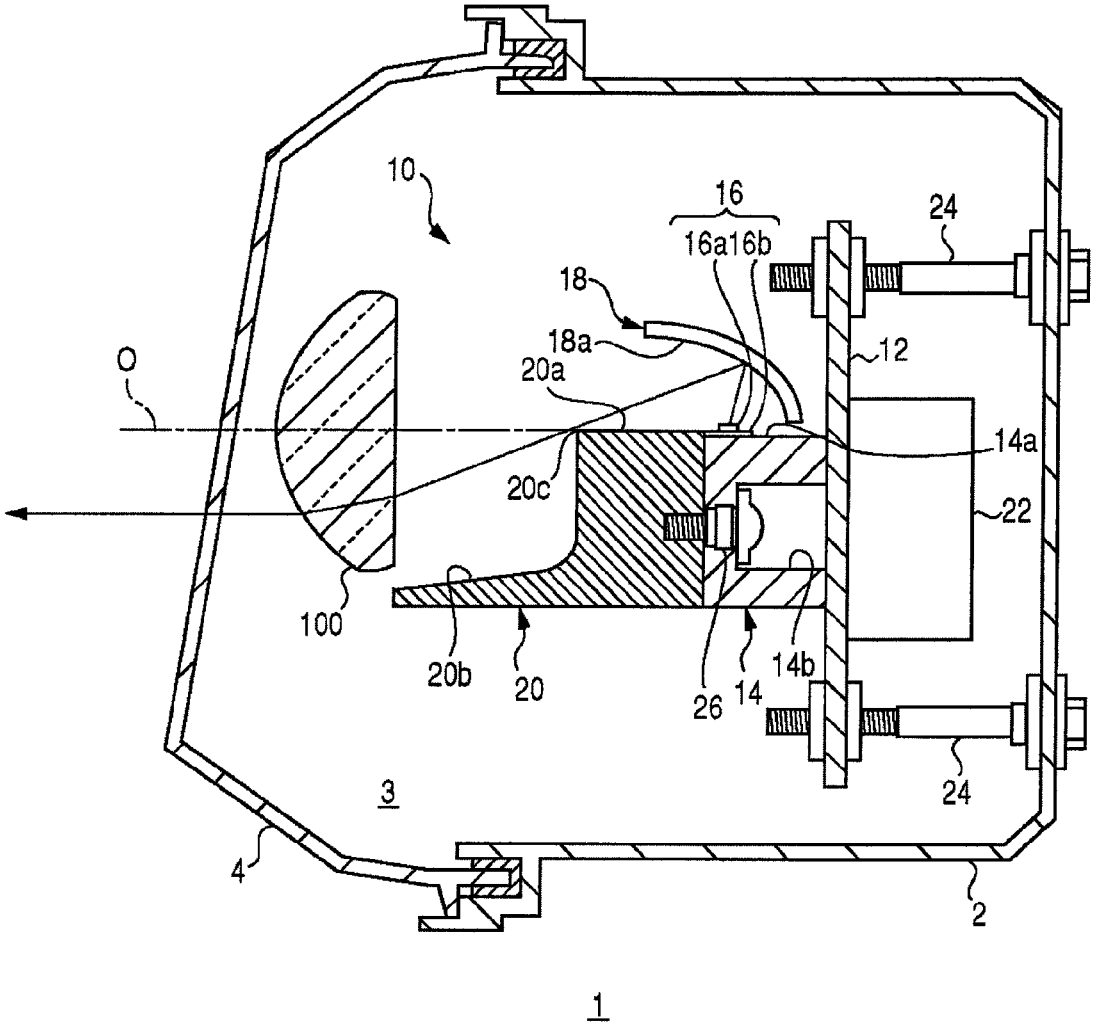
FIG. 1 is a vertical section view schematically showing an outline of the structure of a vehicle lamp in which a lamp unit according to a first embodiment is mounted.

Hereinafter, preferred embodiments of the invention will be described with reference to the accompanying drawings. The same or equivalent constituent elements, members, and processes shown in the respective drawings are denoted by the same reference numerals, and redundant descriptions thereof will be appropriately omitted. Also, the embodiments do not limit the invention and are just examples. All features and combinations thereof described in the embodiments are not necessarily essentials to the invention.

First Embodiment

FIG. 1 is a vertical section view schematically showing an outline of the structure of a vehicle lamp in which a lamp unit according to a first embodiment is mounted. A vehicle lamp 1 which is described in this embodiment is a vehicle headlight device including a pair of headlight units that are disposed on left front and right front sides of a vehicle. The pair of headlight units have the substantially same configuration. FIG. 1 shows the structure of the headlight unit, which is disposed on any one of the left and right sides, as the vehicle lamp 1.

As shown in FIG. 1, the vehicle lamp 1 includes a lamp body 2 having an opening on a vehicle front side and a transparent cover 4 that is attached so as to cover the opening of the lamp body 2. The transparent cover 4 is made of a resin or glass having transparency. A lamp unit 10 is accommodated in a lamp chamber 3 that is defined by the lamp body 2 and the transparent cover 4.

The lamp unit 10 is a so-called projector-type lamp unit. The lamp unit 10 includes a bracket portion 12, a light source mounting portion 14, a light source module 16 (light source), a reflector 18, a shade portion 20 and a projector lens 100.

The bracket portion 12 is a substantially plate-shaped member made of a metal material such as aluminum. Principal surfaces of the bracket portion 12 are directed in front-rear directions of the lamp. The light source mounting portion 14 is fixed on the principal surface, on the front side of the lamp, of the bracket portion 12. Heat radiation fin 22 is fixed to the principal surface, on the rear side of the lamp, of the bracket portion 12. The bracket portion 12 is formed with screw holes at predetermined positions of a peripheral edge part thereof. Aiming screws 24 that extend forward through the lamp body 2 are screwed into the screw holes. Thereby, the bracket portion 12 is attached to the lamp body 2. The vehicle lamp 1 is configured so that an optical axis O of the lamp unit 10 can be adjusted in a horizontal or vertical direction by the aiming screws 24. It should be noted that a shape of the bracket portion 12 is not particularly limited to the one exemplarily described here.

The light source mounting portion 14 is made of a metal material such as aluminum. The light source mounting portion 14 protrudes forward from the principal surface, on the front side of the lamp, of the bracket portion 12. The light source mounting portion 14 has a light source module mounting surface 14*a* that faces upwards in a direction perpendicular to the optical axis O of the lamp unit 10. The light source module 16 is mounted on the light source module mounting surface 14*a*. Also, an insertion hole 14*b* into which a fastening member 26 (which will be described later) is inserted is provided at a predetermined position of the light source mounting portion 14.

The light source module 16 is disposed so that a light emission surface thereof faces substantially upward in the direction perpendicular to the optical axis O. The light source module 16 is, for example, a light emitting diode (LED). The light source module 16 has a light emitting element 16*a* and a substrate 16*b* that supports the light emitting element 16*a*. The substrate 16*b* is provided with a wiring for feeding power to the light emitting element 16*a* mounted thereon. It should be noted that the light source for use in the lamp unit 10 may be an incandescent lamp, a halogen lamp, a discharge lamp or the like. Heat that is generated from the light source module 16 is transferred to the heat radiation fin 22 through the light source mounting portion 14 and the bracket portion 12.

The reflector 18 has a substantial dome shape. The reflector 18 is disposed above the light source module 16 and is fixed to the light source mounting portion 14. The reflector 18 has a reflective surface 18*a* on its inside, which is configured by a free-form surface based on an ellipsoid of revolution. The reflective surface 18*a* has a first focal point and a second focal point that is on the lamp front side of the first focal point. The reflector 18 has such a positional relation with the light source module 16 that a light emission portion of the light source module 16 substantially coincides with the first focal point of the reflective surface 18*a*.

The shade portion 20 is provided on the lamp front side of the light source mounting portion 14. The shade portion 20 is fixed to the light source mounting portion 14 by the fastening member 26, such as a screw, that protrudes from the insertion hole 14*b* of the light source mounting portion 14 toward the front side of the lamp. The shade portion 20 has a planar part 20*a* that is disposed to be substantially horizontal and a curved surface 20*b* that curves downward so as not to prevent, on the lamp front side of the planar part 20*a*, the light source light from being incident on the projector lens 100. The reflector 18 has such a positional relation with the shade portion 20 that a ridge line 20*c* defined by the planar part 20*a* and the curved part 20*b* of the shade portion 20 is positioned near the second focal point of the reflective surface 18*a*.

The shade portion 20 may also function as a lens holder. Then, a fixing part (not shown) of the projector lens 100 may be fixed to a leading end of the curved part 20*b* of the shade portion 20. The projector lens 100 is a transparent member that has a convex surface on a front side surface thereof and that projects forwardly the light from the light source module 16 mounted on the light source mounting portion 14. The projector lens 100 projects an inverted image of a light source image, which is formed on a rear focal plane including a rear focal point of the projector lens, onto a virtual vertical screen which is ahead of the lamp. The projector lens 100 is disposed on the optical axis O of the lamp unit 10 and at such a position that the rear focal point thereof substantially coincides with the second focal point of the reflective surface 18*a* of the reflector 18. The shape of the projector lens 100 will be described in more detail later.

The light emitted from the light emission element 16*a* of the light source module 16 is reflected by the reflective surface 18*a* of the reflector 18, passes through the second focal point of the reflective surface 18*a*, i.e., near the ridge line 20*c* and is then incident onto the projector lens 100. The light incident on the projector lens 100 is illuminated forwardly from the projector lens 100 as substantially parallel light. Also, a part of the light source light is reflected by the planar part 20*a* of the shade portion 20, so that a part of the light source light is selectively cut off by the ridge line 20*c* that serves as a boundary line. Thereby, a light distribution pattern having a cutoff line corresponding to the shape of the ridge line 20*c* is projected forwardly of the vehicle.

Figure 2A:
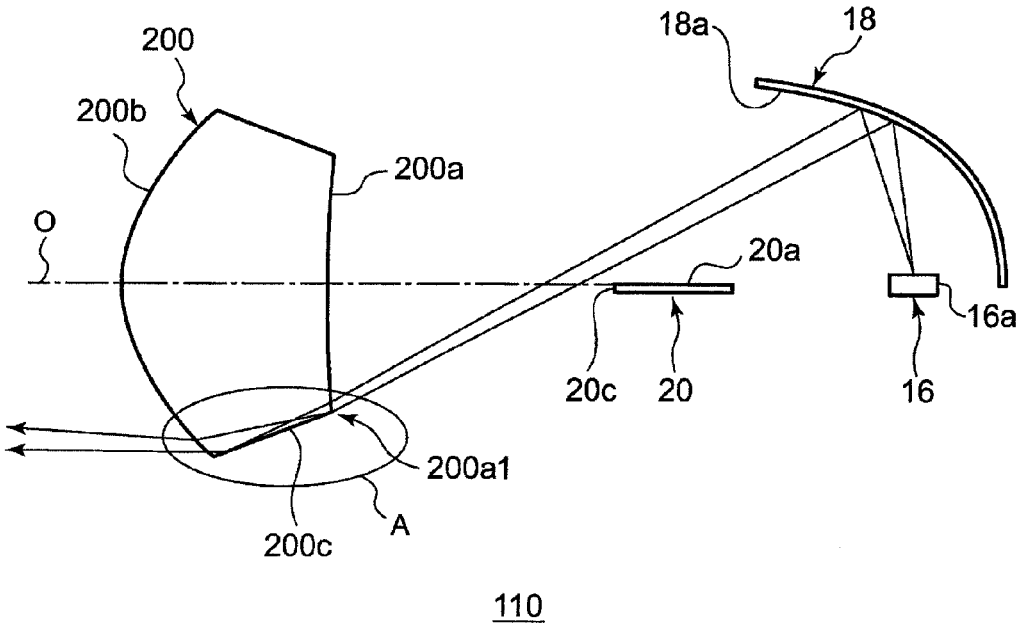
FIG. 2A is a section view schematically showing an outline of the configuration of a lamp unit according to a comparative example.
Figure 2B:
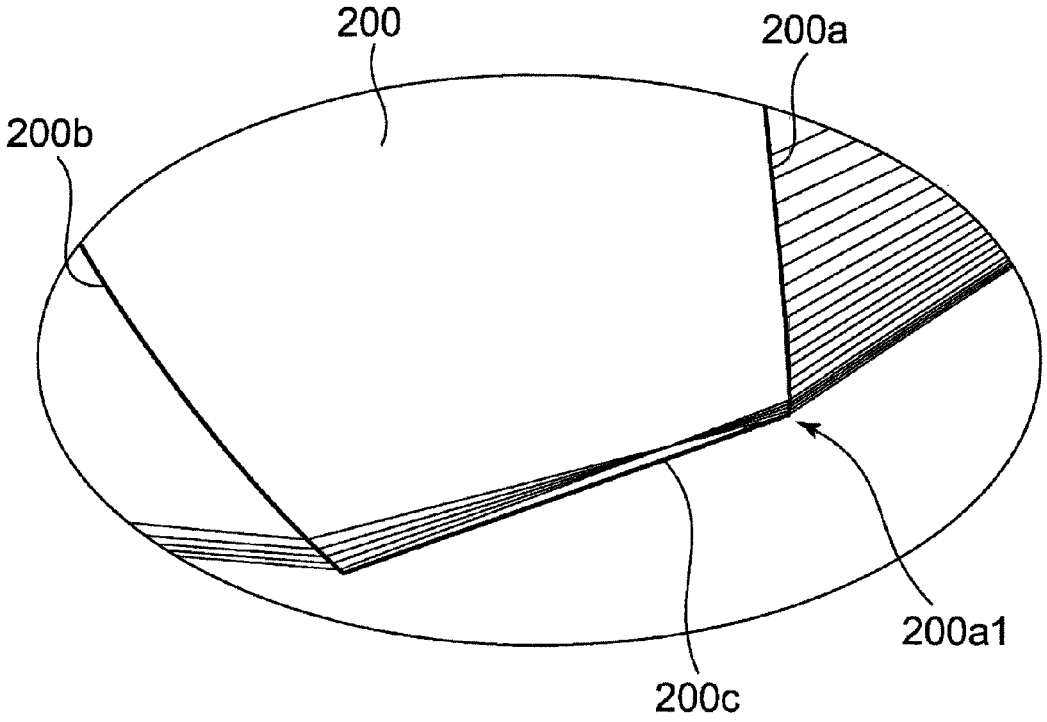
FIG. 2B is an enlarged view of an area A in FIG. 2A.

FIG. 2A is a section view schematically showing an outline of the configuration of a lamp unit according to a comparative example. FIG. 2B is an enlarged view of an area. A in FIG. 2A. It is noted that a lamp unit 110 of the comparative example has the same configuration as that of the lamp unit 10 of the first embodiment, except for a shape of a projector lens 200.

In the lamp unit 110 of the comparative example, the light emitted from the light emission element 16*a* of the light source module 16 is reflected by the reflective surface 18*a* of the reflector 18, passes through the second focal point of the reflective surface 18*a*, i.e., near the ridge line 20*c* and is then incident on the projector lens 200. At this time, a part of the light emitted from the light emission element 16*a* is incident near an outer edge part 200*a*1 of an incident surface 200*a* of the projector lens 200 and refracted. The incident light is directed toward a connection surface 200*c* that annularly connects the incident surface 200*a* and the emission surface 200*b* of the projector lens 200. The connection surface 200*c* is formed so that its shape in section (see FIGS. 2A and 2B) including the optical axis O is flat (linear). Therefore, the light that reaches there with an acute angle with respect to the connection surface 200*c* (an angle between the connection surface 200*c* and the traveling direction of the light is an acute angle), i.e., the light that reaches there with a large incident angle is totally reflected by an internal surface of the connection surface 200*c*. Since the light reflected by the flat connection surface 200*c* is directed toward the emission surface 200*b* with the same reflection angle as the incident angle, the incident angle with respect to the emission surface 200*b* becomes small.

Figure 3:
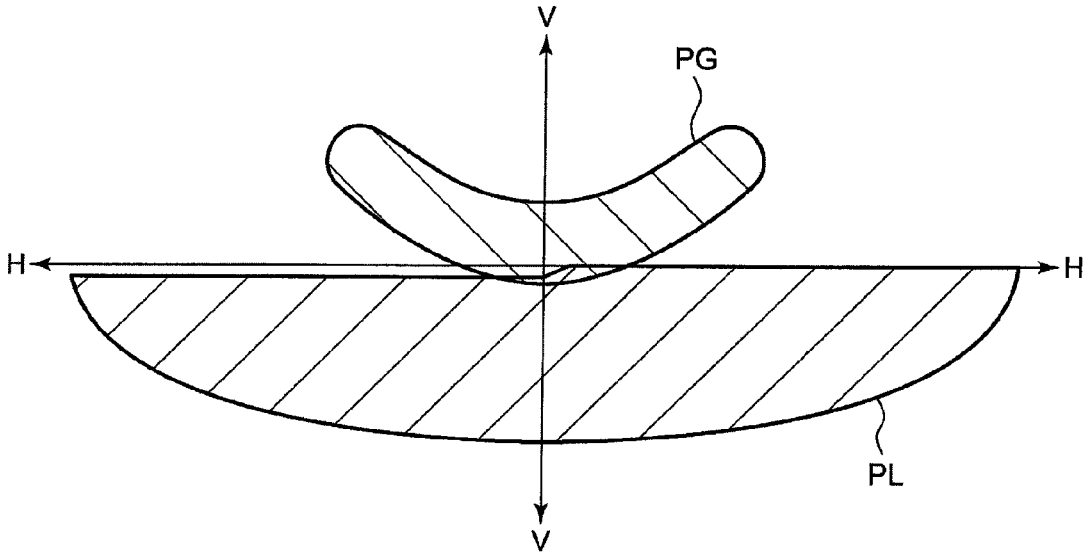
FIG. 3 is a schematic view showing a light distribution pattern that is formed by the lamp unit.

Therefore, the light totally reflected by the connection surface 200*c* is refracted on the emission surface 200*b* and is then illuminated upward. FIG. 3 is a schematic view showing a light distribution pattern that is formed by the lamp unit 110. As shown in FIG. 3, the lamp unit 110 not only forms a desired low beam light distribution pattern PL below a horizontal line (H-H line) but also illuminates an area PG above the horizontal line. Therefore, if a person or another vehicle exists in the area PG ahead of the vehicle, glare may be caused thereto.

As described above, it is difficult to use the light, which is incident near the outer edge part of the projector lens, for the light distribution pattern as compared with the light which is incident on the central part of the projector lens. Then, the inventor studied this matter intensively and found that it is possible to avoid the above phenomenon by devising the shape of the projector lens.

Figure 4A:
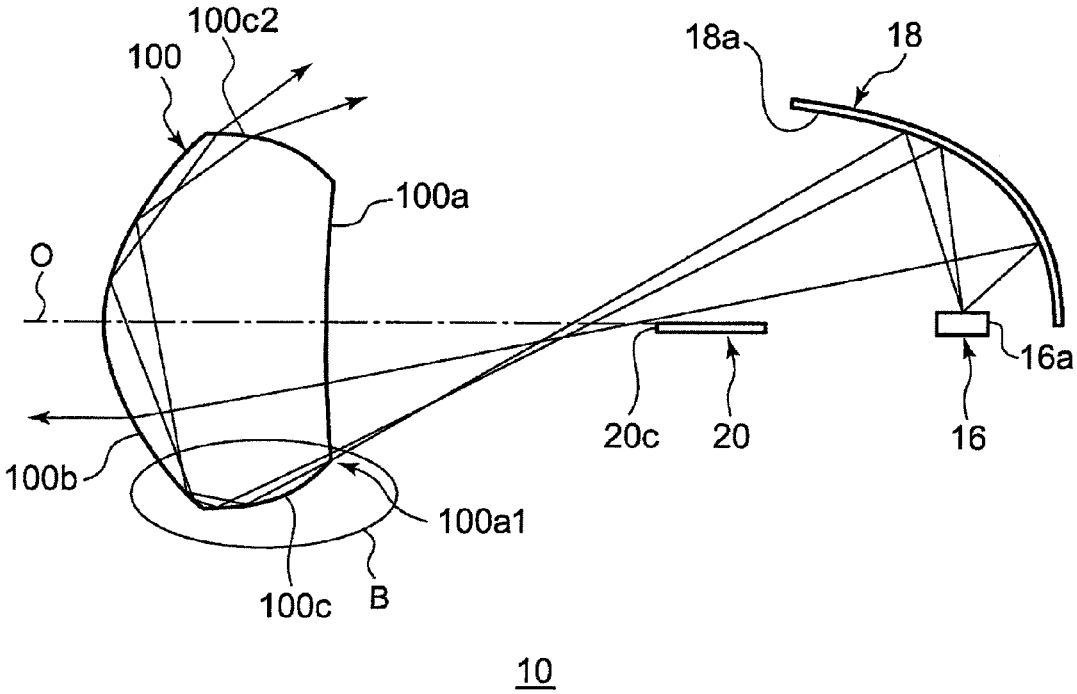
FIG. 4A is a section view schematically showing an outline of the configuration of the lamp unit according to the first embodiment.
Figure 4B:
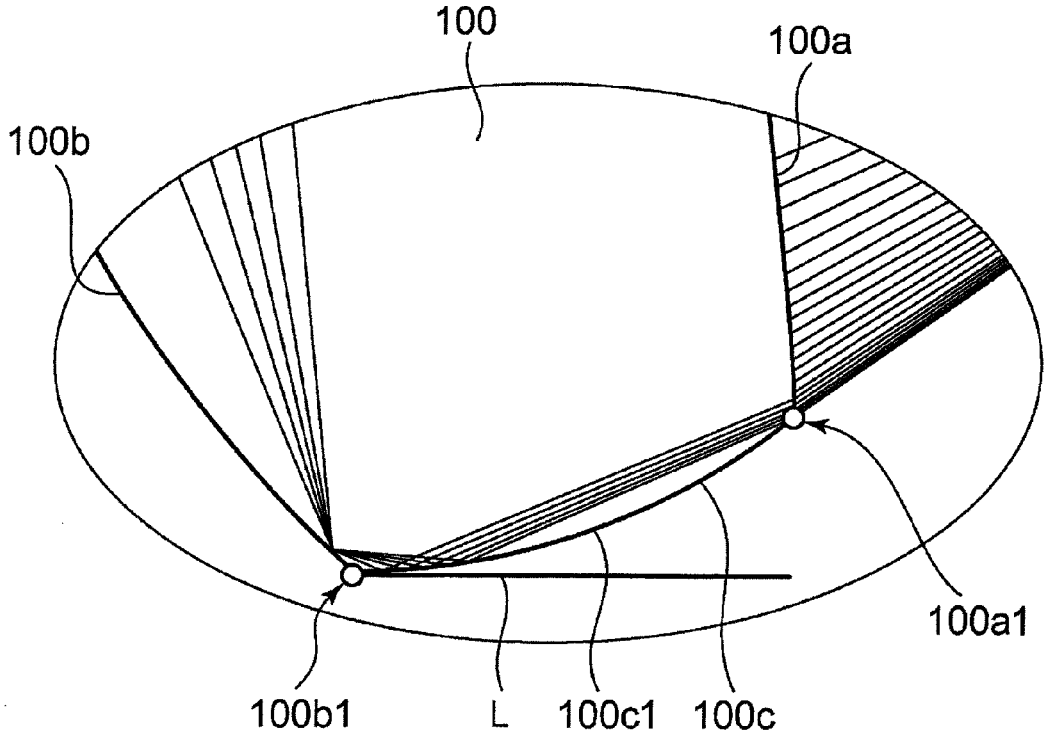
FIG. 4B is an enlarged view of an area B in FIG. 4A.
Figure 5A:
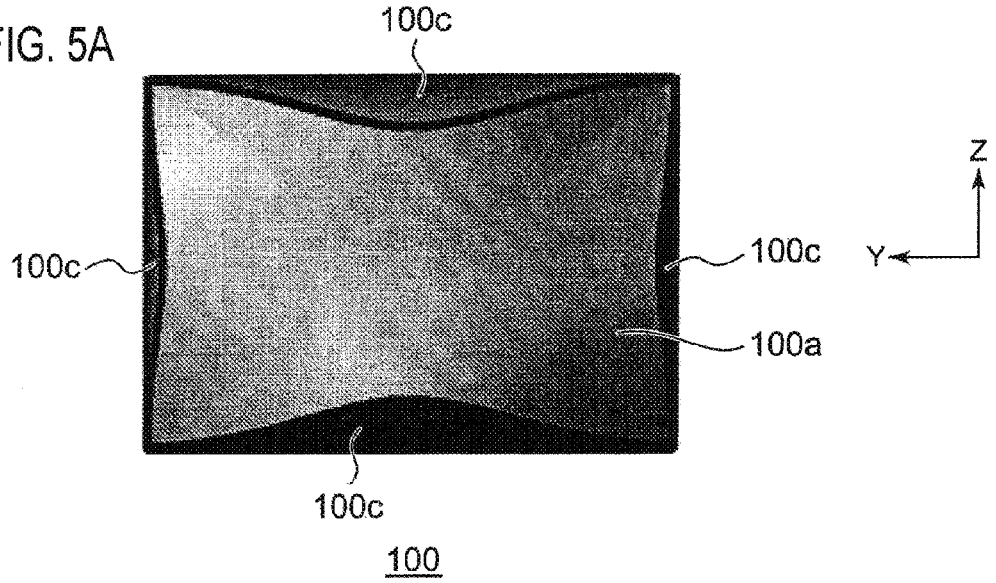
FIG. 5A is a rear view of a projector lens according to the first embodiment when viewed from an incident surface side.
Figure 5B:
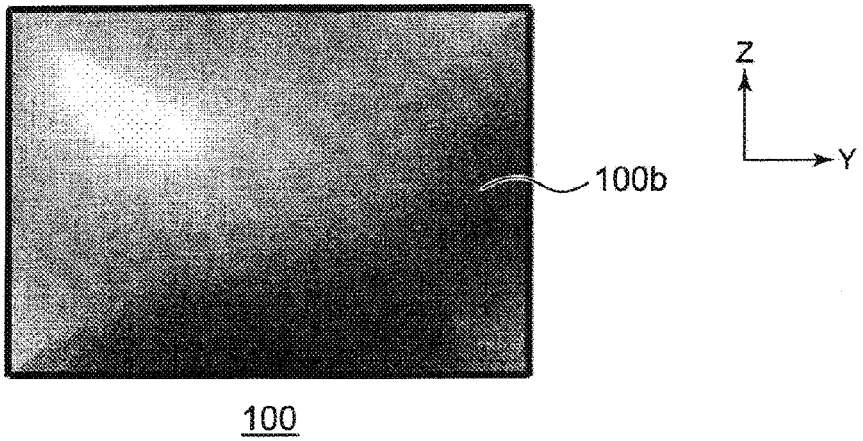
FIG. 5B is a front view of the projector lens when viewed from an emission surface side.
Figure 5C:
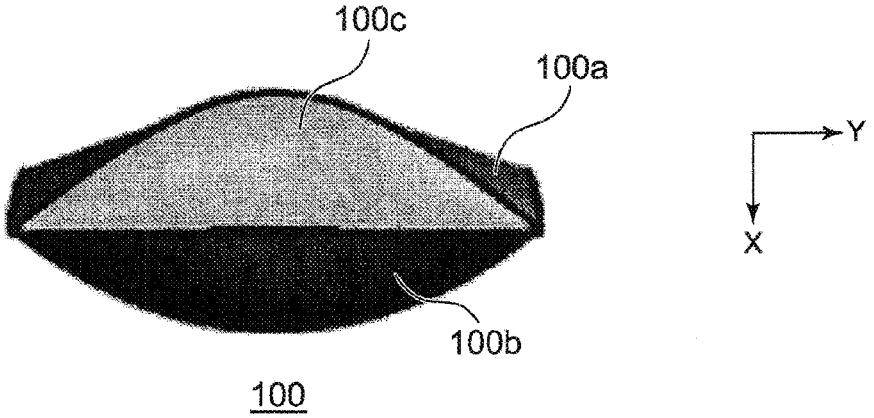
FIG. 5C is a plan view of the projector lens when viewed from above the lamp.
Figure 6A:
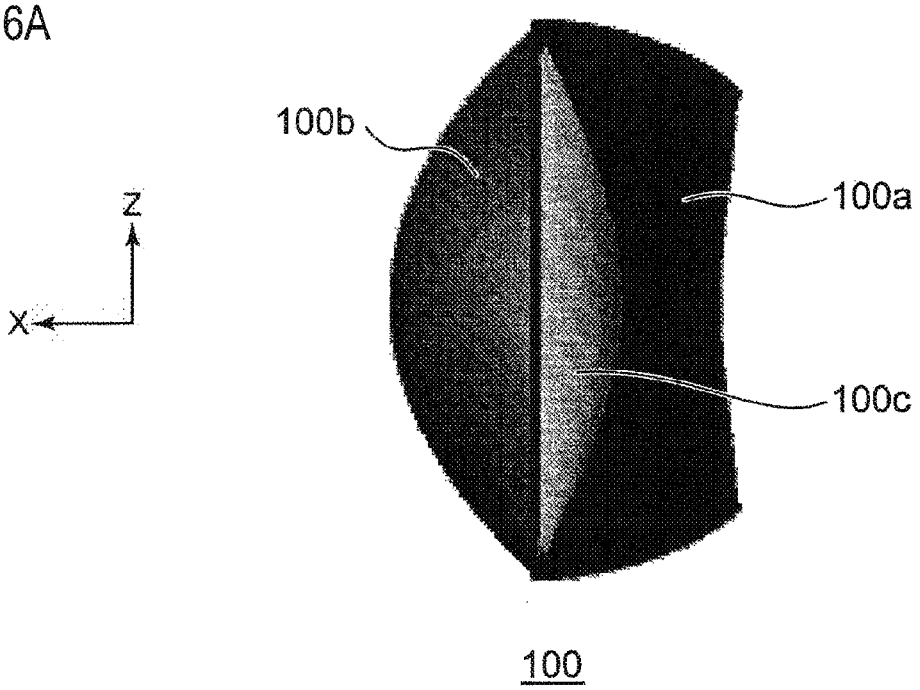
FIG. 6A is a side view of the projector lens according to the first embodiment.
Figure 6B:
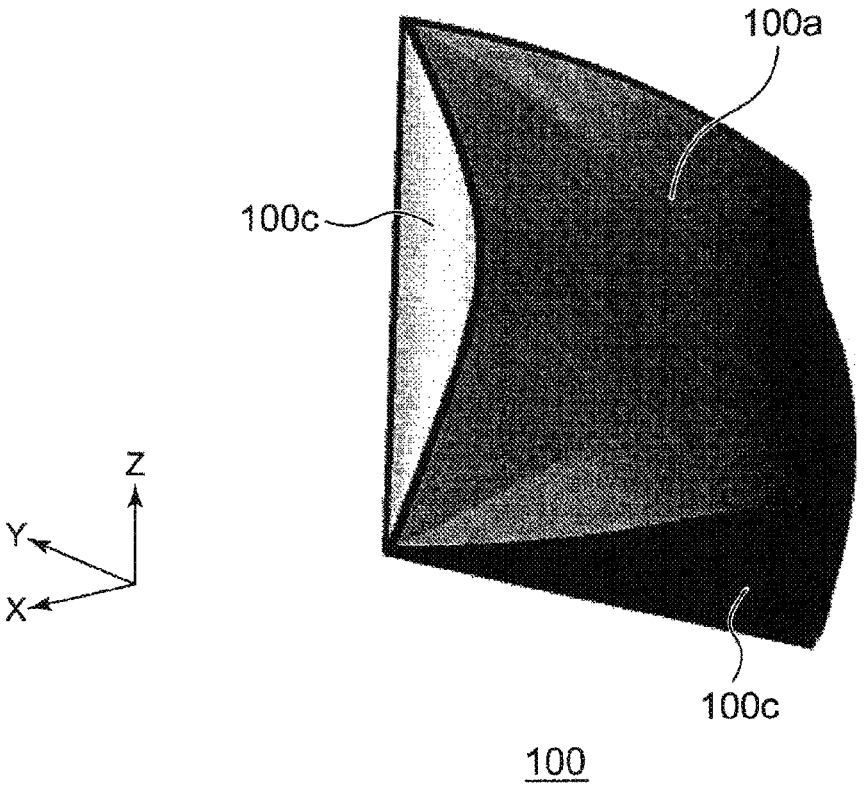
FIG. 6B is a perspective view of the projector lens when viewed from below.

FIG. 4A is a section view schematically showing an outline of the configuration of the lamp unit according to the first embodiment. FIG. 4B is an enlarged view of an area B in FIG. 4A. FIG. 5A is a rear view of the projector lens 100 according to the first embodiment when viewed from an incident surface side thereof. FIG. 5B is a front view of the projector lens 100 when viewed from an emission surface side thereof. FIG. 5C is a plan view of the projector lens 100 when viewed from above the lamp. FIG. 6A is a side view of the projector lens 100 according to the first embodiment. FIG. 6B is a perspective view of the projector lens 100 when viewed from below.

In FIGS. 4A to 6B, an X axis is an axis parallel to the optical axis O, a Y axis is an axis perpendicular to the optical axis O and extending in the right and left direction of the lamp, and a Z axis is an axis perpendicular to the optical axis O and extending in the upper and lower direction of the lamp. Also, FIGS. 4A and 4B correspond to section views taken along a plane including the optical axis O and the Z-axis.

As shown in FIG. 4A, the projector lens 100 is disposed on the vehicle front side of the light source module 16. The projector lens 100 has an incident surface 100*a*, an emission surface 100*b*, and a connection surface 100*c*. Reflected light, which is light emitted from the light emission element 16*a* and reflected by the reflector 18, is incident on the incident surface 100*a*. At least a part of the light incident on the incident surface 100*a* is emitted from the emission surface 100*b* forwardly of the lamp 1. The connection surface 100*c* connects an outer edge part 100*a*1 of the incident surface 100*a* and an outer edge part 100*b*1 of the emission surface 100*b*.

In the lamp unit 10 according to this embodiment, the light emitted from the light emission element 16*a* of the light source module 16 is reflected by the reflective surface 18*a* of the reflector 18, passes through the second focal point of the reflective surface 18*a*, i.e., near the ridge line 20*c* and is then incident on the projector lens 100. At this time, a part of the light emitted from the light emission element 16*a* is incident near the outer edge part 100*a*1 of the incident surface 100*a* of the projector lens 100 and is refracted. The incident light is directed toward the connection surface 100*c* annularly connecting the incident surface 100*a* and emission surface 100*b* of the projector lens 100. The connection surface 100*c* has, in at least a partial area thereof, a convex surface 100*c*1 that is convex, in section including the optical axis O (see FIGS. 4A and 4B), outward in a diameter direction of the projector lens 100. It should be noted that the convex surface 100*c*1 may be formed over the entire circumference of the connection surface 100*c*.

The area including the convex surface 100*c*1 is formed so as to have an arc shape in section including the optical axis O. Specifically, as shown in FIG. 4B, the convex surface 100*c*1 is a circular arc being tangent to a line L, which is parallel to the optical axis O, at the outer edge part 100*b*1 of the emission surface 100*b* and passes through the outer edge part 100*a*1 of the incident surface 100*a*.

Therefore, the incident angle of the light reaching the connection surface 100*c* tends to be smaller than that of the light reaching the connection surface 200*c* of the projector lens 200 of the comparative example. It should be noted that the convex surface 100*c*1 is not limited to a curved surface.

The convex surface 100*c*1 may also be a polygon or a combination of a curved surface and a polygon. Also, the light may be scattered on the inner surface of the connection surface 100*c* by performing a knurling process or a surface texturing process on the connection surface 100*c*.

In the case where the light incident on the projector lens 100 is internally reflected by the connection surface 100*c*, the light reflected by the convex surface 100*c*1 reaches the convex emission surface 100*b* of the projector lens 100 with a larger incident angle than an incident angle with which the light reaches the connection surface 200*c* of the lamp unit 110 of the comparative example having the a flat (linear) shape in section including the optical axis O. Therefore, the light reflected by the connection surface 100*c* is apt to be totally reflected by the emission surface 100*b* of the projector lens 100, and the light reflected by the connection surface 100*c* is not illuminated forwardly from the emission surface 100*b* of the projector lens 100 but is easily emitted toward the vehicle rear side via the connection surface 100*c* or the incident surface 100*a*. In order to scatter the light, which is totally reflected by the emission surface 100*b* and emitted from an upper area 100*c*2 (see FIG. 4A) of the connection surface 100*c*, a surface of the upper area 100*c*2 may be subjected to the knurling process or the surface texture process.

Therefore, the light which is incident near the outer edge 100*a*1 of the projector lens 100 of the lamp unit 10 less contributes to formation of the light distribution pattern. As a result, it is possible to realize the desired light distribution with accuracy when the lamp unit 10 is applied to the vehicle lamp.

In particular, the connection surface 100*c* is configured so that an area of the connection surface 100*c* that is positioned at a lower part of the reflector lens 100 when the lamp unit 10 is used in the vehicle lamp 1 makes up the convex surface 100*c*1. Thereby, of the light reflected by the connection surface 100*c*, the light which is emitted upward from the emission surface 100*b* is reduced as shown in FIG. 4A. As a result, in the lamp unit 10, the light that illuminates the upper area PG of the horizontal line shown in FIG. 3 is reduced, so that it is possible to reduce the glare causing to a person or another vehicle existing ahead of the vehicle.

As shown in FIGS. 5A to 6C, the projector lens 100 of this embodiment is formed so that widths, in the horizontal direction, of the incident surface 100*a* and the emission surface 100*b* are larger than heights, in the vertical direction, thereof. In the related art, a plano-convex lens of a perfect circle has been often used as the projector lens. The plano-convex lens can be easily designed from the viewpoint of optical performance but lacks originality from the viewpoint of design. Also, it is difficult to reduce a size, particularly, a size of the vehicle lamp in the height direction while satisfying the optical performance.

The projector lens 100 according to this embodiment has a rectangular shape when viewed from the front side thereof, and the height thereof in the vertical direction is suppressed. Therefore, it is possible to suppress the height of the vehicle lamp. Also, the height, in the vertical direction, of the projector lens 100 is different from the width, in the horizontal direction, of the projector lens 100, and the projector lens 100 is not a symmetrical rotation body with respect to the optical axis O, such as the plano-convex lens. Therefore, a shape of the connection surface 100*c* is not uniform as compared with a perfect-circle lens. Thus, in view of the optical design, there are many cases where it is difficult to appropriately use the light, which is internally reflected by the connection surface, for the desired light distribution ahead of the vehicle. Then, in order to form the desired light distribution pattern with accuracy, an option that a part of the light is be used can be taken. That is, when the projector lens including the connection surface, which has the shape as described above, is used, it is possible to prevent the light, which is incident near the outer edge part of the incident surface, from being illuminated forwardly of the lamp.

Second Embodiment

Figure 7:
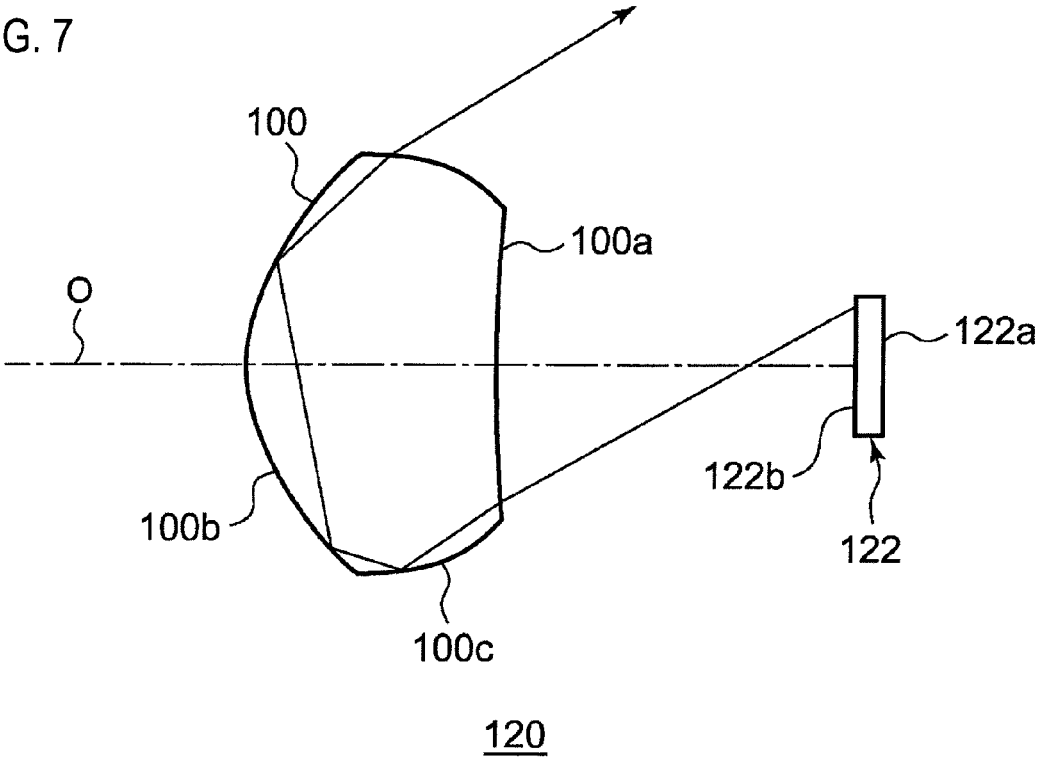
FIG. 7 is a section view schematically showing an outline of the configuration of a lamp unit according to a second embodiment.

FIG. 7 is a section view schematically showing an outline of the configuration of a lamp unit according to the second embodiment. A lamp unit 120 shown in FIG. 7 is a so-called direct projection-type lamp unit. The lamp unit 120 is different from the lamp unit 10 according to the first embodiment in that a light emission surface 122*b* of a light emission element 122*a* of a light source module 122 faces the incident surface 100*a* of the projector lens 100. Also, in the lamp unit 120 configured as described above, the projector lens 100 suppresses the upward light from causing glare, and it is possible realize the desired light distribution with accuracy.

Third Embodiment

In the case where the projector lens having a different shape from the plano-convex lens of the related art is employed considering the design and/or size as described above, if a part of the light emitted from the light source is directly incident on the projector lens 100 without being reflected by the reflector, the light distribution may be non-uniform. Then, the inventor intensively studied this matter and then conceived such a configuration that a light blocking portion is provided on a path that leads straight to the incident surface of the projector lens from the light source so as to prevent the light emitted from the light source from being directly incident on the projector lens.

Figure 8:
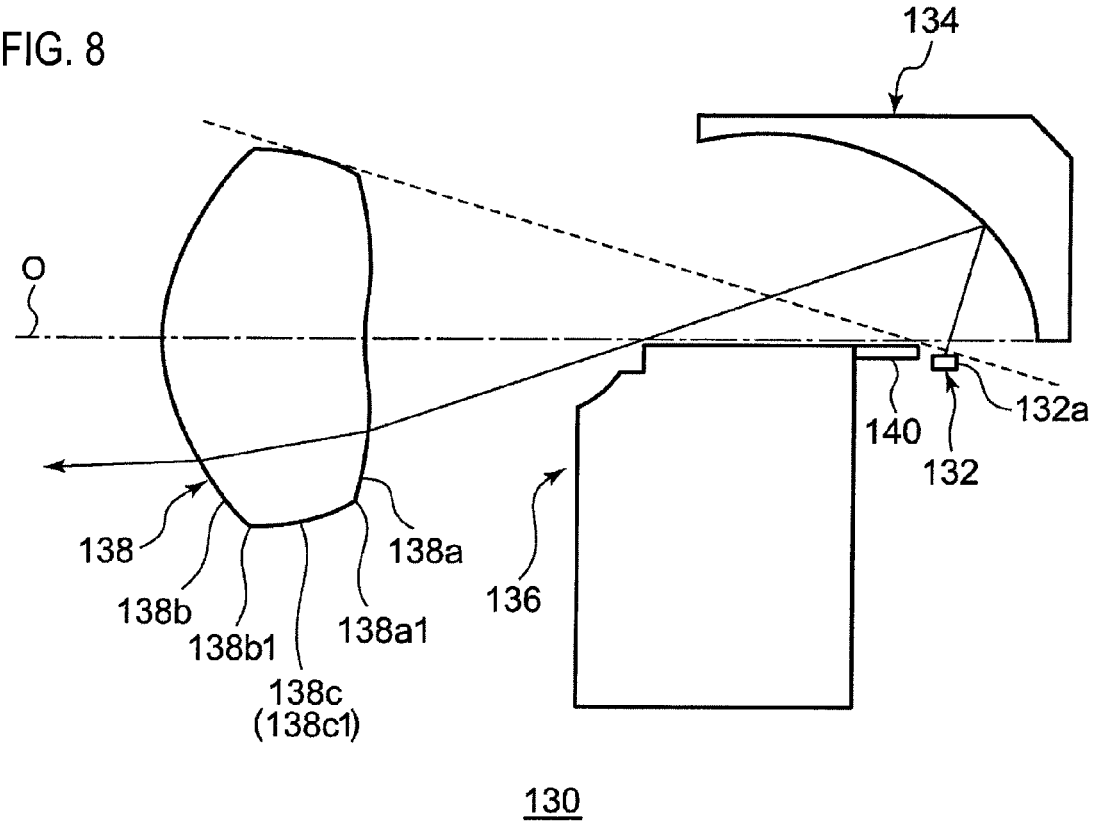
FIG. 8 is a section view schematically showing an outline of the configuration of a lamp unit according to a third embodiment.

FIG. 8 is a section view schematically showing an outline of the configuration of a lamp unit according to the third embodiment. A lamp unit 130 is a so-called reflection-type lamp unit. The lamp unit 130 has a light source module 132 (an example of a light source), a reflector 134, a first shade portion 136 and a projector lens 138.

The projector lens 138 has an incident surface 138*a*, an emission surface 138*b*, and a connection surface 138*c*. Reflected light, which is light emitted from a light emission element 132*a* of the light source module 132 and reflected by the reflector 134, is incident on the incident surface 138*a*. At least a part of the light incident on the emission surface 100*a* is emitted from the emission surface 138*b* forwardly of the lamp. The connection surface 138*c* connects an outer edge part 138*a*1 of the incident surface 138*a* and an outer edge part 138*b*1 of the emission surface. The connection surface 138*c* has, at least in a partial area thereof, a convex surface 138*c*1 that is convex, in section including the optical axis O (see FIG. 8), outward in a diameter direction of the projector lens 138.

Also, the lamp unit 130 is provided with a second shade portion 140 near the light emission element 132*a* so as to prevent the light emitted from the light emission element 132*a* from being directly incident on the projector lens 138. Thereby, the direct light from the light emission element 132*a* is not incident on the projector lens 138. Therefore, it is possible to form the less non-uniform light distribution pattern. Furthermore, the connection surface 138*c* has the convex surface 138*c*1. Thereby, it is suppressed that the light incident on the outer edge part 138*a*1 of the incident surface 138*a* of the projector lens 138 is emitted upward from the emission surface 138*b*.

The invention has been described with reference to the respective embodiments. However, it should be noted that the invention is not limited thereto. The invention also includes ones obtained by appropriately combining or replacing the configurations of the respective embodiments. Also, based on the knowledge of one skilled in the art, the combinations and/or process sequences in the respective embodiments may be appropriately changed and/or modifications such as various design changes may be made in the respective embodiments. The invention can include embodiments to which the modifications are made.

What is claimed is:

1. A lamp unit for use in a vehicle lamp, the lamp unit comprising:

a light source mounting portion on which a light source is mounted; and a projector lens that is disposed on a vehicle front side of the light source, wherein the projector lens includes an incident surface on which light emitted from the light source is incident, a convex emission surface from which the light incident on the incident surface is emitted forwardly out of the lamp, and a connection surface that connects an edge part of the incident surface and an edge part of the emission surface, such that the connection surface, the incident surface and the emission surface are each a separately defined surface, and the connection surface is a convex surface having a continuous curvature, in section including an optical axis, outward in a diameter direction of the projector lens, and is inclined from the edge part of the emission surface to the edge part of the incident surface in a direction toward a central optical axis of the projector lens, such that the light emitted from the light source, incident on the incident surface and reflected by the connection surface reaches the emission surface with a larger incident angle to be totally reflected more by the emission surface as compared with a case where a connection surface connecting the edge part of the incident surface and the edge part of the emission surface has a linear shape in section including the optical axis.

2. The lamp unit according to claim 1, further comprising:

a reflector that reflects the light emitted from the light source to the incident surface of the projector lens, and a first shade portion that blocks off a part of the light reflected by the reflector.

3. The lamp unit according to claim 2, further comprising:

a second shade portion that blocks off a part of the light emitted from the light source so as to prevent the light emitted from the light source from directly being incident on the incident surface of the projector lens without being reflected by the reflector.

4. The lamp unit according to claim 1, wherein the connection surface is configured so that an area of the connection surface that is positioned at a lower part of the projector lens when the lamp unit is used in the vehicle lamp makes up the convex surface.

5. The lamp unit according to claim 1, wherein the convex surface having a continuous curvature is formed so as to have an arc shape or a circular arc shape in section including the optical axis.

6. The lamp unit according to claim 1, wherein the incident surface and the emission surface are formed so that widths in a horizontal direction are larger than heights in a vertical direction.

7. The lamp unit according to claim 1, wherein the convex surface having a continuous curvature is tangent, in section including the optical axis, to a line that passes through the edge part of the emission surface and that is parallel to the optical axis.

8. The lamp unit according to claim 1, wherein the connection surface is subjected to knurling or surface texturing.

9. The lamp unit according to claim 1, wherein the projector lens has a rectangular shape when viewed from an emission surface side of the projector lens.

10. The lamp unit according to claim 1, wherein the projector lens has a rectangular shape when viewed from an incident surface side of the projector lens.

11. The lamp unit according to claim 1, wherein the connection surface is the convex surface having a continuous curvature having a convex surface extending from the edge part of the emission surface toward the edge part of the incident surface.

12. The lamp unit according to claim 1, wherein the incident surface is concave in shape.

13. A projector lens for use in a vehicle lamp, the projector lens comprising:

an incident surface on which light emitted from a light source is incident;

a convex emission surface from which the light incident on the incident surface is emitted forwardly out of the lamp; and a connection surface that connects an edge part of the incident surface and an edge part of the emission surface, such that the connection surface, the incident surface and the emission surface are each a separately defined surface, wherein the connection surface is a convex surface having a continuous curvature, in section including an optical axis, outward in a diameter direction of the projector lens and is inclined from the edge part of the emission surface to the edge part of the incident surface in a direction toward a central optical axis of the projector lens, such that the light emitted from the source, incident on the incident surface and reflected by the connection surface reaches the emission surface with a larger incident angle to be totally reflected more by the emission surface as compared with a case where a connection surface connecting the edge part of the incident surface and the edge part of the emission surface has a linear shape in section including the optical axis.

14. The projector lens according to claim 13, wherein a width of the incident surface in a horizontal direction is larger than a height of the incident surface in a vertical direction, and a width of the emission surface in the horizontal direction is larger than a height of the emission surface in the vertical direction.

15. The projector lens according to claim 13, wherein the convex surface having a continuous curvature is tangent, in section including the optical axis, to a line that passes through the edge part of the emission surface and that is parallel to the optical axis.

16. The projector lens according to claim 13, wherein the projector lens has a rectangular shape when viewed from an emission surface side, and the projector lens has a rectangular shape when viewed from an incident surface side.

17. The projector lens according to claim 13, wherein the connection surface is the convex surface having a continuous curvature having a convex surface extending from the edge part of the emission surface toward the edge part of the incident surface.

18. The projector lens according to claim 13, wherein the incident surface is concave in shape.

* * * * *